United States Patent [19]

Kerwin et al.

[11] 4,084,501

[45] Apr. 18, 1978

[54] PRINTING MACHINE FOR PRINTING GROUPS OF SYMBOLS

[75] Inventors: Daniel Kerwin, Lombard; Walter B. Zoberis, Oak Lawn; John W. Grec, Westmont; James A. McDonald, Palos Heights, all of Ill.

[73] Assignee: The Meyercord Co., Carol Stream, Ill.

[21] Appl. No.: 698,052

[22] Filed: Jun. 21, 1976

[51] Int. Cl.[2] ..... B41F 5/06

[52] U.S. Cl. ..... 101/76; 101/92; 101/219

[58] Field of Search ..... 101/72, 76, 77, 78–82, 101/84–89, 90, 92, 67–70, 93, 93.01, 93.11, 93.25, 110, 288, 291, 219

[56] References Cited

U.S. PATENT DOCUMENTS

| | | | |
|---|---|---|---|
| 1,089,453 | 3/1914 | Wood | 101/425 |
| 2,912,926 | 11/1959 | Haskin, Jr. | 101/76 |
| 2,935,016 | 5/1960 | Miller | 101/92 X |
| 3,120,800 | 2/1964 | Ward | 101/72 |
| 3,237,556 | 3/1966 | Huffman | 101/92 X |
| 3,406,628 | 10/1968 | LeGault | 101/288 |
| 3,474,727 | 10/1969 | Kampf | 101/219 |
| 3,540,372 | 3/1967 | Chambon | 101/92 |
| 3,693,545 | 9/1972 | Kondur | 101/110 |
| 3,734,012 | 5/1973 | Huggins | 101/103 |
| 3,738,263 | 6/1973 | Combs et al. | 101/90 X |

FOREIGN PATENT DOCUMENTS

| | | | |
|---|---|---|---|
| 2,039,664 | 2/1972 | Germany | 101/93 |

*Primary Examiner*—J. Reed Fisher

*Attorney, Agent, or Firm*—Merriam, Marshall & Bicknell

[57] ABSTRACT

This disclosure deals with a machine for printing indicia on a moving web. The web may consist of a long relatively narrow carrier strip having rows of tax stamps or decals formed thereon, and the machine prints indicia in the form of code symbols on each stamp. The stamps are arranged on the carrier strip in rows which extend longitudinally or in the direction of the length of the strip, and the strip is moved longitudinally through the machine during the printing operation. In the described example of the invention, a plurality of such rows are provided, the rows being laterally spaced across the width of the web, and the laterally adjacent stamps are arranged in laterally extending straight lines. The machine prints a group of symbols on each stamp, and the symbols are the same for every stamp on a given length of the web. The machine includes a plurality of printing cylinders or rollers which are spaced longitudinally of the web and which are moved in an oscillating or reciprocating motion toward and away from the web. The number of printing cylinders equals the number of symbols in each group, and each cylinder prints one symbol of each group. The associated printing elements which print a group of symbols are laterally offset relative to each other, in order to produce a side-by-side relation of the symbols of each group. The printing cylinders may be angularly adjusted to change the operative printing elements. The machine further includes mechanisms for handling a length of an inked ribbon or carbon paper and a control circuit for the machine, and the machine performs the multiple functions of separating a large web roll into a plurality of small rolls, and of cleaning the web.

17 Claims, 18 Drawing Figures

56
23
54
257
271
51
268
274
53
172
171
52
181
82
173
91
105
174
281
282
258
69
272
263
264
266
267
273
71

PRINTING MACHINE FOR PRINTING GROUPS OF SYMBOLS

Machines for printing indicia or symbols on a moving web are well known in the prior art. For example, U.S. Pat. No. 3,474,727 which issued on Oct. 28, 1969 to Otto W. Kampf discloses such a machine which is designed to print identification or code symbols on tax stamps used on cigarette packages. The machine disclosed in the Kampf patent includes a rotating printing cylinder having a plurality of angularly spaced strips secured to the outer periphery thereof, each of the strips including a series of printing elements. As the cylinder rotates, the elements contact the moving web and print the symbols on the web. While the machine disclosed in the Kampf patent works well, it has the disadvantage that it is relatively slow in operation and it requires a very large number of different strips in order to print a wide variety of symbols. Such strips are expensive and they present a storage problem.

Another type of machine for printing indicia on such stamps includes a pair of rotating printing cylinders, each cylinder having a large number of numbering machines mounted around its outer periphery. Numbering machines are mounted along the entire length and circumference of each cylinder, and each cylinder prints on alternate rows of the stamps. A machine of this design has the disadvantages that the printing cylinders are very expensive because of the numbering machines, and servicing the numbering machines may be time consuming and involve substantial expense.

Other types of printing machines are also known in the prior art but in all machines known to the applicant, printing is accomplished by a rotating printing cylinder which prints symbols on a web by rotating the printing cylinder and thus moving the printing elements against the web.

It is a general object of the present invention to provide an improved printing machine which is capable of very high speed operation, which does not require a large and expensive set of printing elements, and which is capable of printing an extremely wide variety of different symbols.

A machine in accordance with the present invention is designed to print indicia or symbols on rows of stamps fastened along the width and length of a rapidly moving web. The machine includes two or more printing cylinders and pressure rollers, the printing cylinders being spaced apart in the direction of movement of the web. Each of the printing cylinders includes a plurality of lines of printing elements on its outer periphery, the lines extending parallel to each other and to the axis of the cylinder. The machine further includes means for moving the printing cylinders and the pressure rollers toward and away from each other in an oscillatory or reciprocating motion to press the printing elements against the web. The cylinders cooperate to print a plurality of groups of symbols on the web, and each cylinder prints one symbol of each group. The printing elements of each of the cylinders are offset from the elements of the other cylinders to obtain a side-by-side relation of the symbols of each group.

The machine further includes control circuit means for controlling the drive for the printing rollers, means for rewinding a web and dividing a large roll into a plurality of small rolls, means for cleaning the web, and means for moving a sheet of inked ribbon or carbon paper between the cylinders and the web.

It is another general object of this invention to provide an improved method of printing a plurality of symbols on stamps fastened to a rapidly moving web.

The foregoing and other objects and advantages of the present invention will become apparent from the following detailed description taken in conjunction with the accompanying figures of the drawings, wherein.

Figures 6, 7, 14:
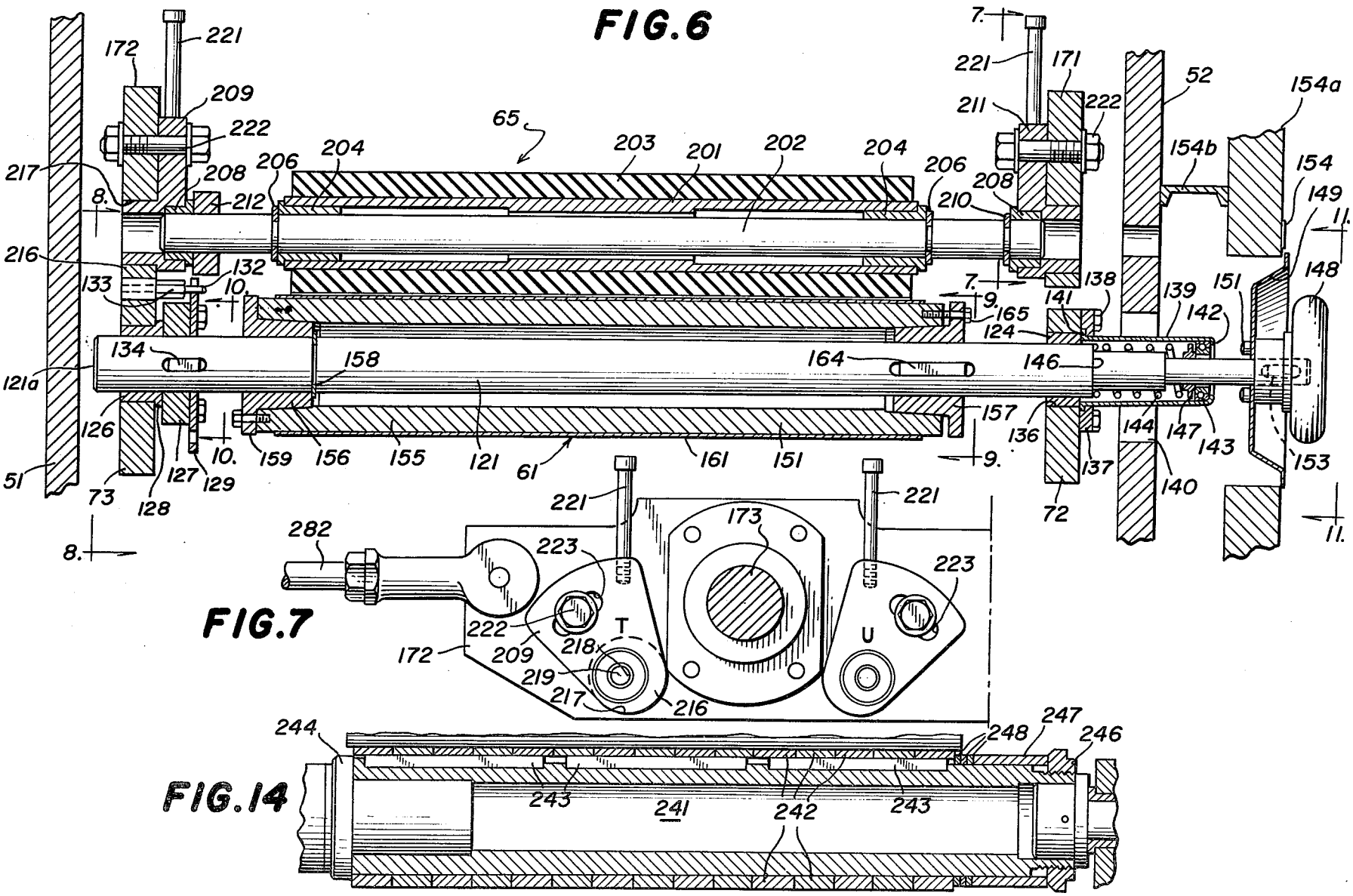
FIG. 6 is an enlarged fragmentry sectional view taken on the line 6—6 of FIG. 2.
FIG. 7 is a fragmentary sectional view taken on the line 7—7 of FIG. 6.
Figure 9:
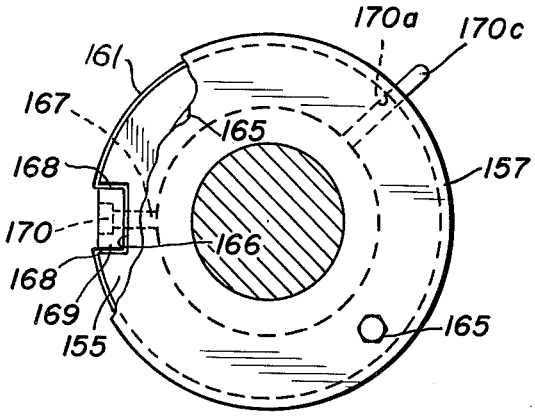
FIG. 9 is a fragmentary sectional view taken on the line 9—9 of FIG. 6.

FIGS. 13, 13A, 13B, 13C, and 13D are schematic views illustrating the printing operation; and FIG. 14 is a fragmentary sectional view showing an alternate form of printing roller.

While the invention has uses in many fields, it is particularly suited for printing code symbols or indicia on revenue or tax stamps formed on a long web, the stamps being of the type which are applied to cigarette packages as required by various municipal and state regulations. The above mentioned Kampf patent contains a detailed description of the construction and use of one type of such stamps. It should be understood that while the machine disclosed herein is designed for such use, the invention is not limited to any particular field of use.

Figures 1, 2:
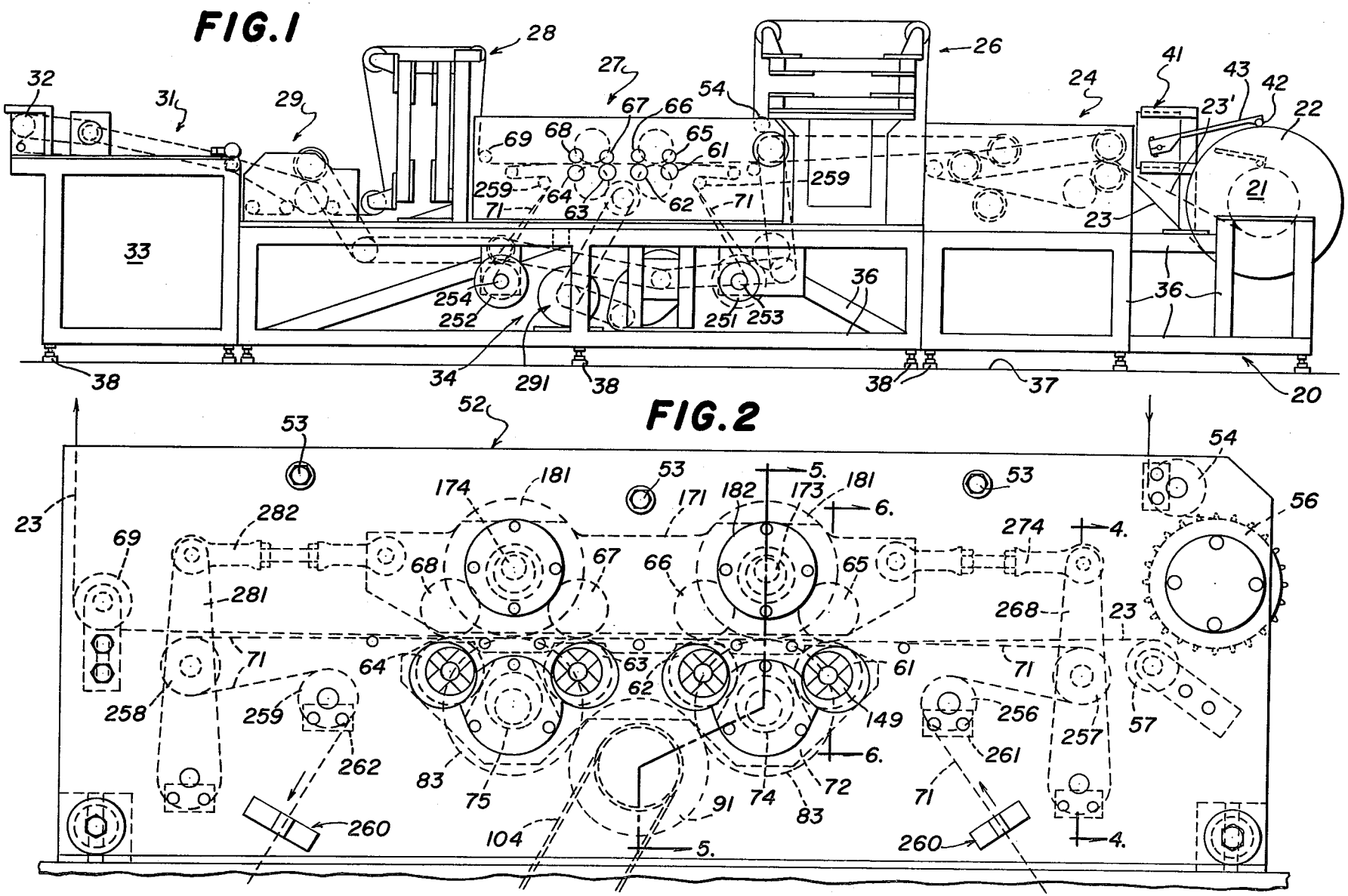
FIG. 1 is a side elevational view of a machine incorporating the invention.
FIG. 2 is an enlarged fragmentary view of a portion of the machine shown in FIG. 1.

With reference to FIG. 1, the machine comprises a frame 20 which supports the various operating parts of the machine, the parts including a roller 21 which supports a supply roll 22 of a long web 23. The solid line representation of the web 23 indicates the position of the web when being drawn from a full or new roll, and the dashed line representation of the web, indicated by the numeral 23', shows the position of the web when the roll 22 is nearly depleted. From the supply roll 22, the web 23 passes through a web cleaning mechanism 24, a web aligner 26, a code printing section 27, a second web aligner 28, a number printing section 29, and an inspection and cutting station 31 to a take-up roller 32 for rewinding the web 23. The machine further comprises a control panel 33 and a drive mechanism 34 for driving the various operating parts of the machine.

The frame 20 may have a conventional construction and therefore will not be described in detail. It comprises a plurality of support members 36, such as structural steel parts, which are secured together as by welding or with bolts. The members 36 of the frame 20 are supported on a firm floor or foundation 37 by a plurality of adjustable feet 38.

The support roller 21 for the web supply roll 22 is rotatably mounted on the frame 20. The web 23 is unwound from the supply roll 22 by pulling the web 23, the pull being exerted by the other parts of the machine during operation. A torque control device 41 including a roller 42 at the end of an arm 43 applies pressure on the outer surface of the supply roll 22 and prevents excessive unwinding of the web 23 from the roll 22.

Figure 13:
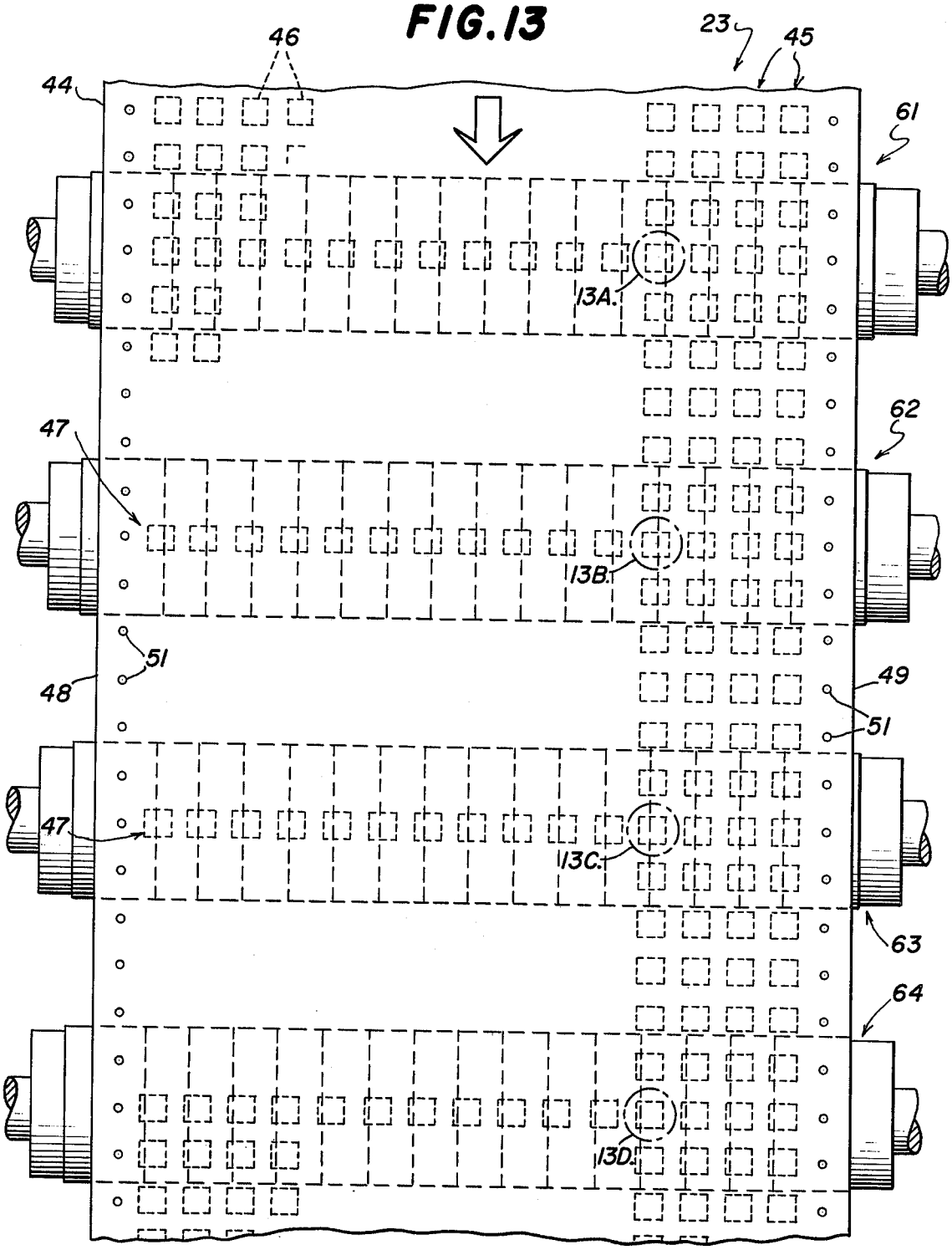

The web 23 is better illustrated in FIG. 13, and comprises an elongated carrier strip 44 of a material such as paper. A plurality of stamps 46 are formed on the web 23, the stamps 46 in the present instance being heat release decals which are formed on the underside of the strip. Such stamps are described in detail in the Kampf patent. In the present instance, the stamps 46 are approximately one-half inch square and they are spaced approximately three fourths of an inch apart, center-to-center, in both the lateral and the longitudinal directions of the web. The stamps 46 are arranged in rows 45 which extend longitudinally of the web and the machine, and in the illustrated example there are fifteen such rows 45. The stamps are also aligned in the lateral direction, and therefore there are fifteen stamps in each laterally extending line 47 of such stamps. Adjacent each longitudinal edge 48 and 49 of the web is a longitudinally extending row of holes 51 which are employed to orient the web as will be explained hereinafter. As previously mentioned, the stamps 46 are decals and they are formed on the web 23 with the side which is viewed when the stamps are on cigarette packages being against or adjacent the strip 44. A stamp 46 is applied to a package by pressing a heated plate on the web 23 over the stamps 46, the heat causing the stamps 46 to be released from the web 23. The heat further activates an adhesive which makes the stamps 46 adhere to the cigarette packages. When the cigarette package is withdrawn from the web 23, the top or the viewed side of the stamp will be facing outwardly. As will be described hereinafter, the printing section 27 of the machine prints code symbols or indicia on the back side of each stamp 46, and the symbols may be viewed through the stamp and read from the front side of the stamp.

The mechanism 24 is designed to clean the web 23 by removing a powder that is normally placed on the web at the end of the process of making the stamps. The web 23 is powdered after the stamps have been formed, the purpose of the powder being to prevent the stamps from sticking to the web when it is rolled up. The mechanism 24, which may have a conventional construction, includes a brush assembly which cleans the powder from the web to permit the printing operations to be described.

The web aligners 26 and 28 may also have a conventional construction and their purpose is to straighten the web and to hold it taut while the web is in the printing section 27. The web 23 may have a tendency to stretch or skew due, for example, to humidity, but the two web aligners 26 and 28 hold the web 23 taut and correctly aligned with the lines 47 of stamps extending exactly laterally of the machine.

The function of the number printing section 29 is to periodically print a number along one edge of the web 23. The machine includes a device for counting the lines 47 of stamps passing through the printing section 27, and in the section 29 the number is periodically printed on the web. For example, a number may be printed on the edge of the web 23 after every twenty of the lines 47. Such numbers enable an operator standing at the inspection and cutting station 31 to know how many lines of stamps have been printed in a particular run. After a certain number of stamps 46 on a section of the web 23 have been printed, the machine is stopped and an operator standing at the station 31 severs the web 23, winds the severed end of the web on the take-up roller 32 and removes it from the roller 32. The operator then attaches a leader to the leading edge of the next section of the web 23, places a new core on the roller 32, threads the leader around the core, and restarts the machine in operation.

FIGS. 2 through 11 illustrate in greater detail the construction of the printing section 27. With specific reference to FIGS. 2 and 3, the printing section 27 comprises a pair of laterally spaced rectangular side plates 51 and 52, each of which has its lower longitudinal edge secured to and supported by the frame 20. A plurality of lateral cross bars 53 extend between the side plates 51 and 52 adjacent their upper edges and brace the plates. The web 23 passes between the two side plates 51 and 52 and extends from the web aligner 26, past an idler roller 54, a pin wheel 56 which engages the holes 51, another idler roller 57, past four printing cylinders 61 through 63 and four pressure rollers 65 through 68, past another idler roller 69, and to the second web aligner 28. In addition to the web 23, an inked ribbon 71 extends between the web 23 and the printing cylinders 61 through 64.

Both the printing cylinders 61 through 64 and the pressure rollers 65 through 68 are mounted for oscillatory or reciprocating motion toward and away from each other in order to apply pressure on the web and the inked ribbon and thereby to print the indicia on the web 23. The four printing cylinders 61 to 64 are mounted for and moved in an oscillatory motion by two laterally spaced printer brackets 72 and 73 (FIGS. 2 and 6) which extend parallel to and just inside the two side plates 52 and 51, respectively. The two printer brackets 72 and 73 are driven in the oscillating motion by a pair of eccentric drive shafts 74 and 75 (FIGS. 2 and 5) which move the brackets 72 and 73 in the oscillatory motion toward and away from the pressure rollers 65 through 68. With specific reference to FIG. 5, the ends 76 and 77 of the shafts 74 and 75 are mounted for rotation on the two side plates 52 and 51, respectively, by ball bearings 78. At the end 76, the ball bearing 78 is positioned in a hole 79 formed in the side plate 52, and a cover member 81 is bolted to the plate 52 over the outer end 76 of the shaft 74, the cover 81 serving both to hold the ball bearing 78 in place and to cover the ball bearing. At the other end 77 of the shaft 74, the bearing 78 is similarly held in place in the side plate 51. However, a cover 82 for the bearing 78 has a central opening formed therein, and the end 77 of the shaft 74 extends through the opening in the cover 82 and is secured to a drive gear 83. The gear 83 is secured to a member 84 by bolts 86, and the member 84 is fastened to the outer end of the shaft 74 by a key 87. Consequently, rotative movement of the gear 83 will turn the member 84, and the ends 77 and 76 of the shaft 74 will rotate about an axis 88.

The gear 83 is driven by a drive gear 91 which meshes with the gear 83 and is fastened to a shaft 92. The shaft 92 is supported by a pair of ball bearings 93 which carry the shaft 92 in a housing 94. The gear 91 is secured to a member 96 by bolts 97, and the member 96 is fastened by a key 98 to the outer end of the shaft 92. The inner end 101 of the shaft 92 is fastened to a pulley 102 by a key 103, and a timing belt 104, when driven, turns the pulley 102 and the shaft 92. The opposite ends of the shaft 92 are threaded and nuts 105 secure the parts together. It will be apparent from the foregoing that when the timing belt 104 is driven, the shaft 92 and the gear 91 will turn and drive the gear 83 and the eccentric drive shaft 74.

Figures 3, 4:
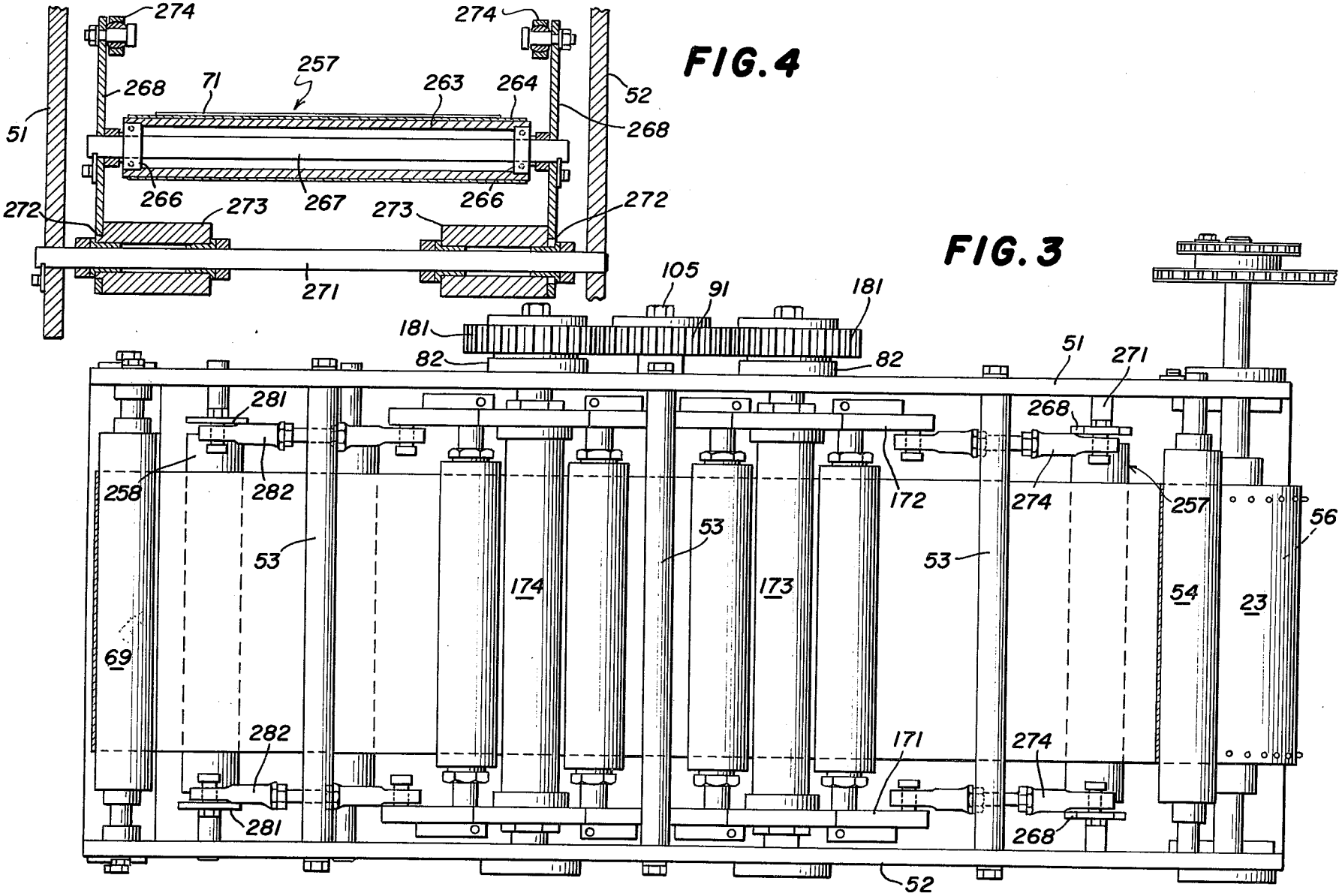
FIG. 3 is a fragmentary plan view of the portion shown in FIG. 2.
FIG. 4 is a fragmentary sectional view taken on the line 4—4 of FIG. 2.
Figures 5, 8:
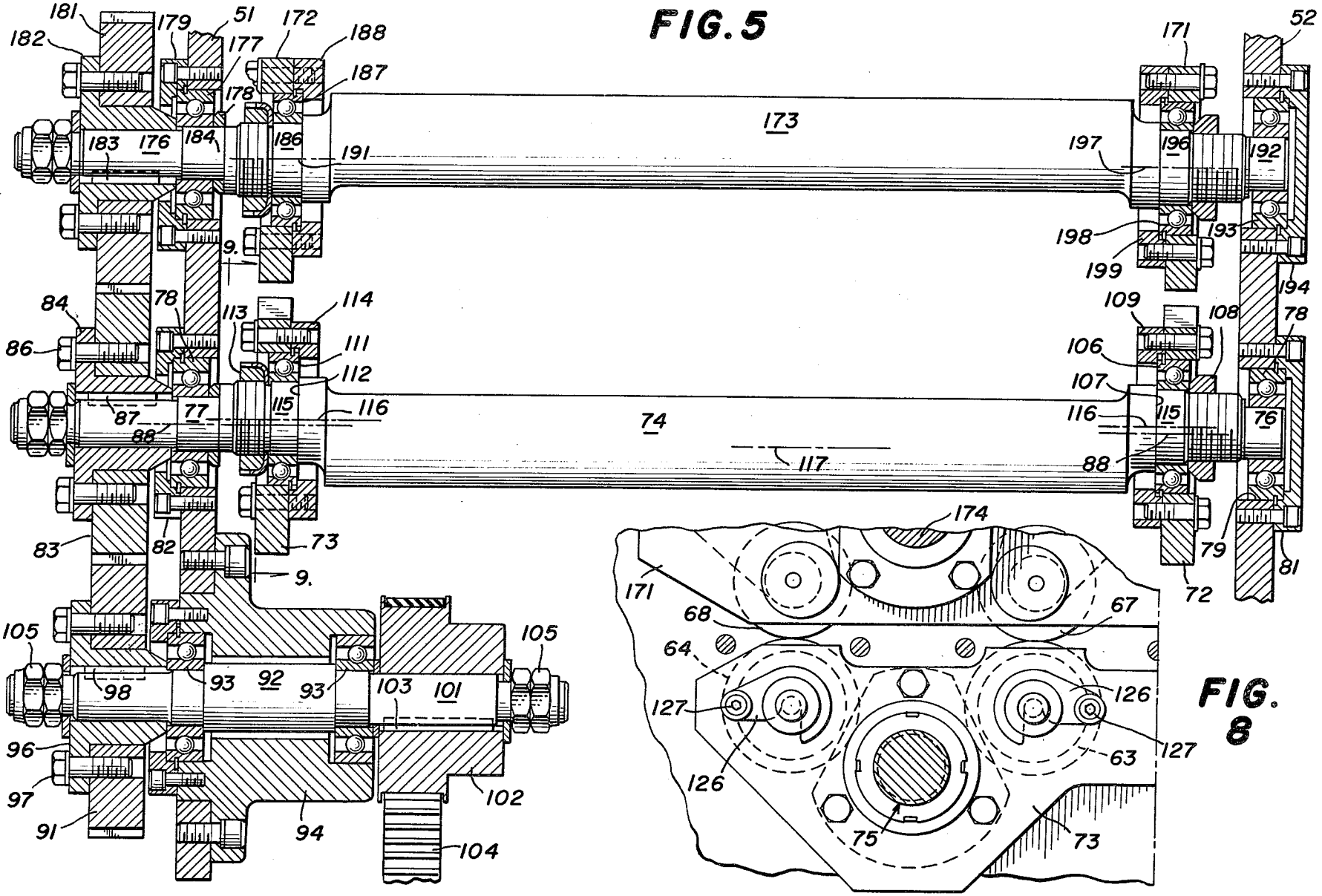
FIG. 5 is an enlarged fragmentary sectional view taken on the line 5—5 of FIG. 2.
FIG. 8 is a fragmentary view taken on the line 8—8 of FIG. 6.

The drive for the other eccentric drive shaft 75 is the same as the construction illustrated in FIG. 5 and therefore is not illustrated and described in detail. As shown in FIGS. 2 and 3, the gear 91 and the pulley 102 are located between and engage both gears 83 associated with the two shafts 74 and 75, and consequently, the two shafts 74 and 75 are driven in timed relation by the belt 104.

The two printer brackets 72 and 73 are carried by the eccentric drive shafts 74 and 75. The bracket 72 (FIG. 5) is supported adjacent the end 76 of the shaft 74 by a ball bearing 106, the bearing 106 being secured in place between a shoulder 107 formed on the shaft 74 and a nut 108 is threaded on the shaft 74 adjacent the end 76. An annular member 109 secures the outer race of the bearing 106 to the bracket 72.

At the end 77, the drive shaft 74 is similarly connected to the bracket 73. A ball bearing 111 is secured to the drive shaft 74 between a shoulder 112 and a nut 113 which is threaded on the shaft 74 adjacent the end 77, and an annular member 114 secures the outer race of the bearing 111 to the bracket 73.

For each of the bearings 78, 93, 106, 111, and for bearings 177, 187, 193 and 198, to be mentioned hereinafter, a snap ring is fastened in a groove in the periphery of the outer bearing race and the ring is forced against an outer housing part in order to hold the bearing in place.

The two bearings 106 and 111 are mounted on eccentric parts 115 of the shaft 74, there being one part 115 at each end of the shaft 74. It will be apparent from FIG. 5 that the aligned axes 116 of the parts 115 and of the two bearings 106 and 111 are offset relative to the axes 88 of the two ends 76 and 77 and the bearings 78. Consequently, when the drive shaft 74 is rotated, the axes 116 will swing in a circular motion around the axes 88, and the two brackets 72 and 73 will also move in this circular motion.

The central portion of the drive shaft 74, which is the portion between the bearings 106 and 111, is preferably offset in the direction which is away from the axes 116 in order to serve as a counterbalancing weight. The axis of the central portion is indicated by the reference numeral 117.

The other eccentric drive shaft 75 is constructed the same as the shaft 74 and it is mounted the same as shown in FIG. 5. Further, the orientation of the various axes of the shaft 75 is the same as for the shaft 74. Consequently, the two plates 72 and 73 will be maintained parallel to each other and horizontal, and the two brackets will simultaneously move in the circular motion previously described. Since the four printing cylinders 61 through 64 are supported between the two brackets 72 and 73, they will, of course, also move in the circular motion previously described.

Figure 10:
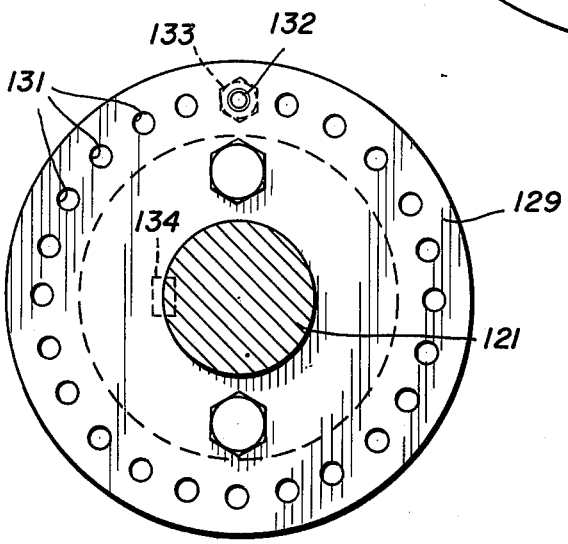
FIG. 10 is a fragmentary sectional view taken on the line 10—10 of FIG. 6.

With reference to FIG. 6, the printing cylinder 61 is held against rotation relative to the brackets 72 and 73 during printing, but is capable of angular adjustment in order to change the symbol to be printed. With reference to FIGS. 6 and 8 to 11, the printing cylinder 61 comprises a rod 121 which extends laterally of the machine and is supported at its ends by the two brackets 72 and 73. Bushings 124 and 126 are positioned between the shaft 121 and the brackets 72 and 73. Adjacent the bracket 73, a split or C-type clamp 127 is positioned around and tightened on the rod 121. A flange 128 on the bushing 126 is located between the bracket 73 and the clamp 127, the bushing thereby being held in place. Secured to the other side of the clamp 127 is an annular plate 129 (FIG. 10) which is positioned around the rod 121 and is bolted to the clamp 127. A plurality of angularly spaced holes 131 are formed near the outer periphery of the plate 129, and a pin 132 extends into one of the holes. The pin 132 (FIG. 6) is screwed into a hole formed in the bracket 73 and is secured in place by a nut 133. As is best shown in FIG. 10, a key 134 is positioned in key slots formed in the rod 121 and in the inner peripheries of the plate 129 and the clamp 127, and the key holds the parts against angular movement relative to each other.

At the other end of the rod 121, the bushing 124 is tightly pressed into a hole 136 formed in the bracket 72. A split clamp 137 is fastened to the bracket 72 by bolts 138 and holds a tubular spring housing 139 which extends through a large hole 140 found in the side plate 52. The housing 139 has a flange 141 at one end thereof, which is held between the split clamp 137 and the bracket 72. The other end of the housing 139 is flared inwardly at 142 which holds a ball bearing 143 in place. A coiled compression spring 144 is positioned between a shoulder 146 formed on the rod 121 and a spring seat 147 which abuts the inner race of the bearing 143. It will be apparent that the spring 144 urges the rod 121 toward the lift as seen in FIG. 6 relative to the bracket 72 and the spring housing 139, and that, therefore, the spring 144 holds the plate 129 and the clamp 127 against the bushing 126 and engaged with the pin 132. The pin 132 and the plate 129, of course, hold the rod 121 against angular movement.

Figure 11:
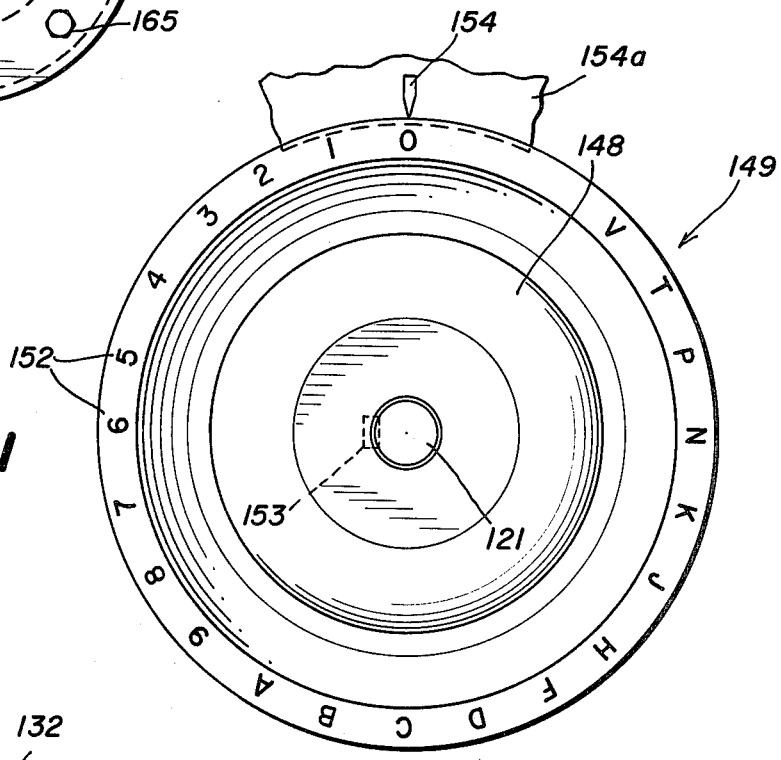
FIG. 11 is a fragmentary sectional view taken on the line 11—11 of FIG. 6.

The rod 121 may however be angularly adjusted when desired in order to change the symbol to be printed. A knob 148 is attached to the right hand end of the rod 121, and an indicator plate 149 (FIG. 11) is attached by screws 151 to the knob. The plate 149 has symbols 152 formed adjacent its outer periphery as shown in FIG. 11, and the angular locations of the symbols 152 are aligned with the holes 131 of the plate 129 and with printing elements of the cylinder. A shaft key 153 connects the knob 148 and the plate 149 to the rod 121 and angularly orients the parts. Each of the symbols 152 corresponds to a line of printing elements of the cylinder, and a pointer 154 indicates the symbol which is in the operative or printing position. In the embodiment of the invention described herein, the pointer 154 is mounted on a sound deadening wall **154*a* which is fastened to the side plate 52 by a bracket 154*b***.

To angularly adjust the printing cylinders 61, an operator pulls the knob 148 and the rod 121 until the plate 129 disengages from the pin 132. The operator then turns the knob slightly until a different symbol is adjacent the pointer 154. Release by the operator of the knob 148 enables the spring 144 to move the rod 121 toward the left and the plate 129 to move into engagement with the pin 132.

Figure 12:
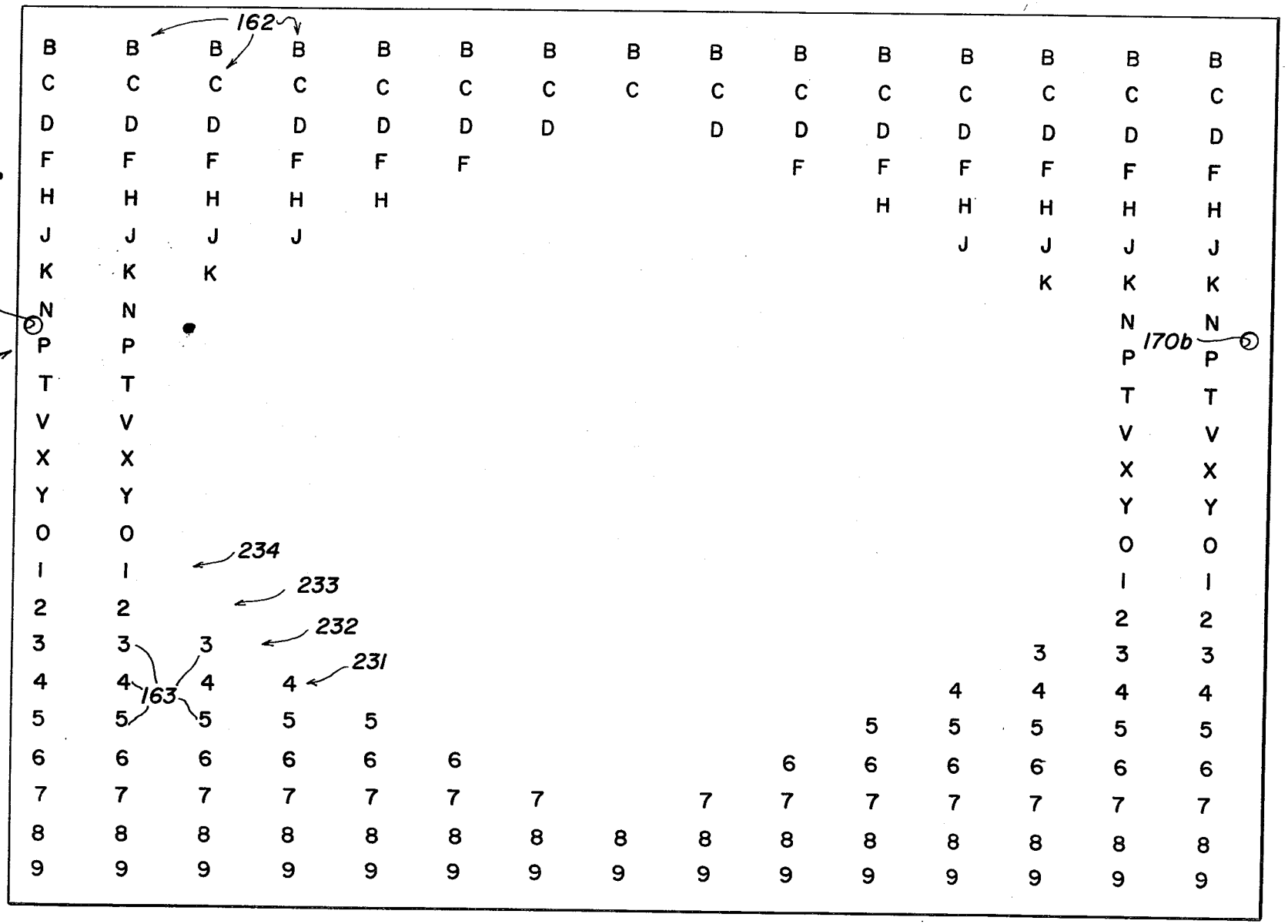
FIG. 12 is a view of a printing plate in accordance with the invention.

In the form of the invention illustrated in FIGS. 6 and 12, which is the preferred form of the invention, the printing cylinder 61 includes a printing plate 162 (FIG. 12) which is wrapped around the outer surface of a hollow rigid tubular member 155 (FIG. 6). The tubular member 155 is positioned on the rod 121 between the two brackets 72 and 73 and it is secured in place by two tapered bushings 156 and 157 at the left and right hand ends respectively of the tubular member 155. With regard first to the left hand end of the rod 121, a snap ring 158 is fastened in an annular groove formed in the outer periphery of the rod 121, and the bushing 156 is moved up to and against the ring 158. The outer periphery of the bushing 156 is tapered as shown in FIG. 6 while the inner periphery of the bushing 156 is straight. The bushing 156 is forced onto the left end of the tubular member 155 until a flange 159 of the bushing 156 engages the end surface of the member 155. The inner periphery of the tubular member 155, at its left hand end, is also tapered, and as the bushing 156 is forced into the member 155, the tapered surfaces bind and the bushing 156 and is squeezed radially inwardly causing the bushing 156 to tightly grip the rod 121. Since the bushing 156 engages the ring 158 and the left hand end of the member 155 engages the bushing flange 159, it will be apparent that the tubular member 155 is accurately located in the lengthwise direction on the rod 121.

With regard to the right hand end of the printing cylinder assembly, the outer periphery of the bushing 157 is also tapered and the inner periphery of the tubular member 155 at this end has a corresponding or mating taper. Key slots are formed in the outer periphery of the rod 121 and in the inner periphery of the bushing 157, and a key 164 angularly orients the bushing 157 relative to the rod 121. The bushing 157 is forced into the right hand end of the tubular member 155 causing the bushing 155 to grip the rod 121, and a pair of bolts 165 (FIGS. 6 and 9) are employed to hold the bushing 157 in the tubular member 155.

Thus, the two tapered bushings 156 and 157 rigidly mount the tubular member 155 on the rod 121. The bushing 156 and the snap ring 158 locate the member 155 along the length of the rod 121, and the key 164 and the bolts 165 angularly locate the bushing 157 and the member 155 on the rod 121.

The printing plate 161 (FIGS. 6 and 12) comprises a sheet of a relatively hard material such as a stiff plastic, having raised printing elements on its outer surface. As shown in FIG. 12, the sheet 161 is rectangular and the printing elements are formed in rows 162 which extend longitudinally of the web and the machine. In the example being described herein wherein code symbols are printed on tax stamps, the web 23 contains a total of fifteen stamps in each laterally extending line 47, as illustrated in FIG. 13. There is therefore an equal number, or fifteen, of rows 162 of printing elements so that a symbol will be printed on each of the stamps 46. The lateral spacing of the rows 162 of the printing elements 163 is, of course, the same as the spacing of the rows 45 of the stamps 46. With reference of FIG. 12, there are twenty-two different elements 163 formed on the plate 149 in each row 162, and the elements of all of the rows 162 are identical.

As previously mentioned and as shown in FIG. 12, the printing plate 161 is initially in the form of a flat rectangular member which is flexible enough to be wrapped around the tubular member 155. The plate 161 is fastened to the outer periphery of the tubular member 155 in the manner illustrated in FIG. 9. A channel or groove 166 is formed in the outer periphery of the tubular member 155, the groove 166 being generally rectangular in cross section and extending longitudinally the full length of the member 155. At the bottom of the groove 166 are formed a plurality of threaded holes 167. When assembling a plate 161 with a tubular member 155, the plate 161 is folded around the outer surface of the tubular member 155 and the end portions 168 of the plate 61 initially overlie the groove 166. A locking bar 169 is positioned over the end portions 168 of the plate 161, and screws 170 are used to draw the bar 169 into the groove 166. Of course, as the bar 169 is forced into the groove 166, it forces the end portions 168 of the plate 161 to bend and fold against the side surfaces of the groove 166. A tight fit is provided between the parts so that the end portions 168 of the plate 161 are rigidly clamped in the groove 166, and the plate 161 is pulled tightly against the outer surface of the member 155.

It is also of course necessary that the printing plate 161 be properly located, both angularly and lengthwise, relative to the tubular member 155. This is accomplished by forming radially extending aligning holes **170*a* (FIG. 9) adjacent the ends of the tubular member 155 and aligning holes 170*b* (FIG. 12) in the printing plate 161. Before mounting the printing plate 161 on the member 155, an aligning pin 170*c* is positioned in each of the holes 170*a* of the tubular member 155, and the printing plate 161 is positioned with the holes 170*b* over the two pins 170*c*. The holes 170*b* in the plate 161 are, of course, located so that the plate 161 will be in the desired position. The printing plate 161 is then securely fastened to the tubular member 155 using the bar 166 as previously explained, and then the two aligning pins 170*c*** are removed.

In summary, the parts are properly aligned as follows:

The pins **170*c* properly locate the printing plate 161 on the tubular member 155; The snap ring 158 locates the axial position of the member 155 on the rod 121; The key 164 angularly locates the bushing 157 relative to the rod 121 and the bolts 165 locate the bushing 157 on the tubular member 155; The key 135 angularly locates the plate 129 relative to the rod 121; and, the key 153 angularly locates the rod 121 relative to the handle 148 and the plate 149. The rod 121 accurately located on the machine frame before the clamp 127 is tightened, by positioning a spacer (not shown) between the left hand end 121a of the rod 121 and the side plate 51. When these parts are tightly engaged, the clamp 127 is tightened, and the spring 144 then holds the clamp 127 against the shim 126 when the spacer is removed. The thickness of the spacer is preselected to place the printing elements 163 in proper lateral registration with the stamps 46 on the web 23**.

The foregoing parts are so oriented that the symbols 152 on the plate 149 are aligned with the laterally extending lines of printing elements 163 so that the particular symbol 152 which is adjacent the pointer 154 will correspond to the printing element of the line that is in the operative or printing position.

The other three printing cylinders 62, 63 and 64 are constructed identically with the printing cylinder 61 with the exception that each printing plate 162 is laterally offset relative to the printing plates 161 of the other three printing cylinders. One method by which a lateral offset of the various printing plates 161 may be obtained is simply to laterally offset the locations of the grooves in the four rods 121, which receive the snap rings 158. By this method, the entire assembly including the member 155 and the plate 161 of each printing cylinder will be laterally offset from the corresponding assemblies of the other cylinders. The same spacer would be used between the end 121*a* of each rod 121 and the side plate 51. Another method is to make the locations of the aligning holes 170*a* of the tubular members 155 laterally offset. By either of the above methods, the printing plates 161 for the four printing cylinders may all be identically constructed and the printing elements will be properly laterally offset. The purpose of this offset mounting will be discussed in more detail hereinafter in connection with FIG. 11.

Alternatively, the lateral offset could be obtained by offsetting the holes 170*b* of the printing plates, or by offsetting the locations of the rows 162 of the printing elements.

The pressure rollers 65 through 68 are mounted and move similarly to the four printing cylinders 61 through 64. The four pressure rollers 65 through 68 are supported by two pressure brackets 171 and 172 (FIGS. 2, 3 and 5 to 7), and two eccentric drive shafts 173 and 174 are provided to move the brackets 171 and 172 in a circular or oscillatory motion similar to the motion of the two brackets 72 and 73. With specific reference to FIG. 5, the drive shaft 173 is constructed and mounted similarly to the shaft 74. The left-hand end 176 of the shaft 173 is mounted on the side plate 51 by a ball bearing 177. The bearing 177 is secured in place between a ring 178 on the shaft 173 and a plate 179 which is secured by bolts to the side plate 51. The outer end of the shaft 173 is secured to a gear 181 by a member 182 which is fastened to the gear 181 by bolts and to the outer end of the shaft 173 by a key 183. The gear 181 engages the gear 83 for the shaft 74, and consequently the rotating shaft 92 drives the four shafts 74, 75, 173 and 174 in synchronism. The axis of rotation of the end 176 is indicated by the reference numeral 184. The shaft 173 also includes an eccentric portion 186 which is fitted in a ball bearing 187, the bearing 187 being attached to the bracket 172 by a plate 188. The axis of the eccentric portion 186 is indicated by the reference numeral 191, and it will be noted that the axis 191 is displaced downwardly from the axis 184.

At the other end of the shaft 173, the outer end 192 is rotatably supported on the side plate 52 by a ball bearing 193 which is held in place by a plate 194. The axis of rotation of the end 192 is in alignment with the axis 184. The right hand of the shaft 173 also includes an eccentric portion 196 having an axis 197 which is in alignment with the axis 191. The eccentric portion 196 is supported by a ball bearing 198 on the bracket 171, another member 199 being provided for this purpose.

The center area of the shaft 173, which is the area between the eccentric portions 186 and 196, is offset in the opposite direction in order to form a counterweight.

The construction and arrangement of the other eccentric drive shaft 174 is the same as for the shaft 173 and consequently will not be described and illustrated in detail. The two shafts 173 and 174 support the two brackets 171 and 172 and maintain them horizontal and parallel to each other while moving them in an oscillatory motion.

The drive shafts 74, 75, 173 and 174 are arranged such that the axes 116 (FIG. 5) for the two shafts 74 and 75 are at their maximum upwardly displaced positions at the same time that the axes 191 and 197 of the two shafts 173 and 174 are at their maximum downwardly displaced positions. Consequently, during operation of the machine the four brackets 72, 73, 171 and 172 will alternately swing toward each other and away from each other.

As previously mentioned, the two pressure brackets 171 and 172 carry the four pressure rollers 65 through 68. With reference to FIG. 6, the pressure roller 65, which is constructed and mounted identically with the other three pressure rollers, comprises a tubular member 201 which is supported by a rod 202. Around the outside of the member 201 is a relatively thick layer 203 of a resilient material such as hard rubber. Cylindrical bushings 204 are positioned in the ends of the member 201 and around the rod 202 and abut opposite ends of the member 201. Snap rings 206 are positioned in annular grooves formed in the rod 202 adjacent the outer surfaces of the bushings 204 and hold the bushings in place. The outer ends of the rod 202 are supported by bushings 208 which, in turn, are supported by adjustable members 209 and 211 that are adjustably fastened to the pressure brackets 172 and 171. A snap ring 210 is fastened to the rod 202 adjacent the right hand bushing 208 and a C-shaped clamping collar 212 is fastened to the rod 202 adjacent the bushing 208, thereby holding the rod 202 against axial movement while permitting the pressure roller to rotate.

The members 209 and 211 are mounted to enable an adjustment to be made of the degree of pressure between the pressure roller 65 and the printing cylinder 61. With reference to FIG. 7, the member 209 includes a round eccentric portion 216 which is rotatably mounted in an opening 217 formed in the bracket 172. The axis of the eccentric portion 216 and the opening 217 is indicated by the reference numeral 218 in FIG. 7. The reference numeral 219 indicates the axis of the rod 202. It will be noted that the axis 219 is offset from the axis 218, and therefore, when the members 209 and 211, at opposite ends of the rod 202, are pivoted on the axis 218, the axis 219 will swing in an arcuate motion around the axis 218. Consequently, the position of the axis 219 of the pressure roller 65 may be moved upwardly or downwardly relative to the printing roller 61, thereby permitting an adjustment to be made of the degree of pressure exerted by the pressure roller 65 on the web 23 between it and the printing roller 61 at the time printing takes place. A bolt 221 is threaded into the upper end of each member 209 and serves as a handle for an operator of the machine. A locking bolt 222 is positioned through an arcuate elongated slot 223 formed in each member 209 and 211 and is positioned in holes formed in the brackets 172 and 171. The members 209 and 211 may be rotatably adjusted by loosening the bolts 222 and, of course, when the bolts 222 are tightened after an adjustment has been made, the members 209 and 211 are held at the adjusted position.

Figure 13A:
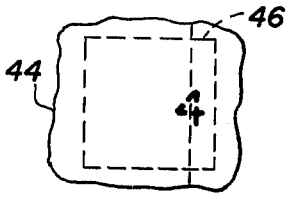

FIGS. 13, 13A, 13B, 13C and 13D illustrate the web 23 and the four printing cylinders 61 to 64, and show the manner in which the symbols are printed on the stamps 46. Assume that the code symbols 1234 are to be printed on the back side of each stamp 46 on a given section of the web 23, and that the web 23 is moving from top to bottom as seen in FIG. 13. FIG. 13 is a view looking downwardly on the upper side of the web 23, the four printing cylinders 61 through 64 being below the web 23 and the stamps 46 being on the underside of the web 23. The inked ribbon 71 is between the web 23 and the printing cylinders, but it is not shown in FIG. 13 for clarity. The pressure rollers 65 through 68 also are not shown in FIG. 13. To print the number 1234 on each stamp, the printing cylinder 61 is angularly adjusted, using the knob 148 as previously described, to place the printing plate line indicated by the reference numeral 231 in FIG. 12, in the printing or operative position which is on the uppermost side of the cylinder 61. All of the printing elements of the laterally extending line 231 are designed to print the number 4. THe cylinder 62 is angularly adjusted to move the line 232 of its printing plate into the operative position, the printing elements of the line 232 being designed to print the number 3. The printing cylinder 63 is adjusted to move the line 233 of its printing plate into the operative position, this line 233 being designed to print the number 2, and the cylinder 64 is adjusted to move the line 234 of the operative position, this line printing the number 1. As each laterally extending line 47 of the stamps 46 passes the printing cylinder 61, the brackets 72 and 73 swing upwardly and, simultaneously, the brackets 171 and 172 swing downwardly, and the cylinder 61 presses against the inked ribbon 71 and the web. Consequently, the printing cylinder 61 prints the numeral 4 on the underside of every stamp 46 in every line of stamps as the lines pass, as shown in FIG. 13A. It is of course necessary that the rate of movement of the web 23 be timed with the speed of the drive for the shafts 74, 75, 173 and 174 so that the printing cylinders and the pressure rollers will be moved together for each line of stamps. As will be noted in FIGS. 13 and 13A, the position of the printing plate 161 of the cylinder 61 is such that the number 4 is printed adjacent the right hand edge, as seen in FIG. 13A, of each stamp.

Figure 13B:
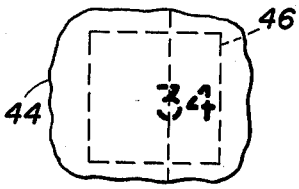
Figure 13C:
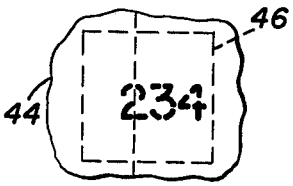
Figure 13D:
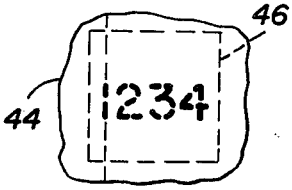

As the web 23 moves downwardly as seen in FIG. 13 and as each line 47 moves into the printing position above the cylinder 62, the number 3 is printed on the back side of each stamp as shown in FIG. 13B. As shown in FIG. 13, the cylinder 62 is shifted or offset to the left slightly relative to the cylinder 61, so that the number 3 is printed laterally alongside the previously printed number 4. Similarly, as the lines of stamps pass the printing cylinder 63, the number 2 will be printed on each stamp immediately along side of the previously printed number 3 as shown in FIG. 13C and as the rows pass the cylinder 64, the number 1 will be printed on each stamp as shown in FIG. 13D.

It will be apparent that the previously described lateral offset or spacing of the printing elements of the four printing cylinders produces a group of printed symbols on each stamp, and the offset of the symbols is the same as in customary printed matter. For each longitudinal row 45 of stamps, the symbols are printed by an associated group of four printing element, one element of the associated group being on each of the four printing cylinders. Thus, the four printing cylinders cooperate and, together, print the symbols on all of the stamps. Since there are fifteen rows 45 of stamps to be printed, there are also fifteen associated groups of printing elements. Of course, in a web construction where there are more or fewer rows 45 than fifteen, there would be a different number of groups of printing elements.

In the preferred embodiment of the invention described above, all of the printing elements for each printing cylinder are formed on a single printing plate as shown and described in connection with FIG. 12. An alternative construction is illustrated in FIG. 14 wherein the printing plate is formed by a plurality of separate bands or rings. The printing cylinder illustrated in FIG. 14 comprises a tubular member 241 having fifteen rings or bands 242 fastened to its outer periphery. The number of bands equals the number of printing elements in a laterally extending line which is, in the example being described, fifteen. Keys 243 are positioned in laterally extending grooves in the member 241 and the bands 232 in order to hold the bands 242 against angular movement on the member 241 and to angularly orient the bands on the member 241. The bands 242 are clamped on the member 241 by collars 244 and 246 which are threaded onto the opposite ends of the member 241 and clamp the bands 242 between them. At the right hand end, as seen in FIG. 14, of the member 241, a sleeve 247 is positioned between the collar 246 and the bands 242, and three spacers or shims 248 are positioned between the sleeve 247 and the bands 242. Since the three shims 248 are at the right hand end of the bands, the bands 242 are at their maximum or extreme leftward position. To obtain the lateral offset relation of the printed numbers as previously described, one or more of the shims 248 may be positioned at the left hand end of the member 241 between the collar 244 and the bands 242 in order to shift the bands 242 toward the right. The thickness of each shim 248 is equal to the desired amount of the lateral offset of the symbols printed on the stamps, and consequently, the desired lateral positions of the printing elements may be obtained by positioning one or more of the shims 248 at the left or right ends of the bands 242.

The printing cylinder shown in FIG. 14 would, of course, be mounted on brackets similar to the mounting of the printing cylinders 61 to 64, and the remainder of the machine may be as previously described. While the use of the bands 242 may result in a greater expense than the use of a printing plate 161, the bands 242 have an advantage in that, if a printing element breaks, it is necessary to replace only the band containing the broken printing element, rather than an entire printing plate.

As previously mentioned, a long strip 71 of inked ribbon is provided to make imprints on the web 23. With reference to FIGS. 1 and 2, the ribbon 71 extends between a first roll 251 and a second roll 252 which are respectively mounted on arbors 253 and 254. The strip 71 is threaded around a drive roller 256 and an idler roller 257 on the upstream side of the printing cylinders, and around a drive roller 259 and an idler roller 258 on the downstream side. The drive rollers 256 and 259 extend laterally of the machine between the side plates 51 and 52 and are rotatably supported on the plates by mounting brackets 261 and 262 (FIG. 2).

The roller 257, which is arranged similarly to the roller 258, is better illustrated in FIGS. 3 and 4, and comprises a tubular member 263 having a cover 264 thereon. The member 263 is rotatably mounted by bearings 266 on a rod 267, the outer ends of the rod 267 being fastened to two generally vertically extending arms 268. The lower ends of the arms 268 are pivotally mounted on a laterally extending rod 271 which has its ends fastened to the two side plates 51 and 52. The arms 268 are mounted at opposite ends of the rod 261 by bushings 272 and support assemblies 273. As is best shown in FIG. 4, the arms 268 extend upwardly from the rod 271 and the rod 267 is connected to approximately the centers of the two arms 268.

The upper ends of the two arms 268 are connected by two horizontal links 274 to the adjacent ends of the two pressure brackets 171 and 172. As shown in FIGS. 2 and 3, one of the links 274 is connected to the upstream end of each of the brackets 171 and 172 and to the upper end of the adjacent arm 268. A ball and socket type of connection is provided at each end of each link 274 to enable the links to pivot freely.

The roller 258 at the downstream side of the printing section 27 is similar to the roller 257 and is similarly mounted on two pivotable arms 281 (FIGS. 2 and 3). The arms 281 also have their lower ends pivotally fastened to the side plates 51 and 52, and links 282 are pivotably connected between the upper ends of the arms 281 and the downstream ends of the brackets 171 and 172. The construction and mounting of the arms 281 and the links 282 are the same as for the arms 268 and the links 274.

Due to the connection of the brackets 171 and 172 with the arms 268 and 281, the arms and the rollers 257 and 258 will swing or pivot about the lower ends of the arms 268 and 281 as the brackets 171 and 172 move in the circular motion. As shown in FIG. 2, the inked ribbon 71 extends between the web 23 and the printing cylinders 61 to 64. As the printing cylinders and the pressure rollers swing toward each other to print, the printing cylinders simultaneously swing in the counterclockwise direction and the pressure rollers simultaneously swing in the clockwise direction as seen in FIG. 2. At the instant that printing takes place, the adjoining surfaces of the printing cylinder and pressure roller of each pair are moving toward each other and toward the left, and when printing takes place, the web 23 is also moving toward the left at the same speed. Further, the section of the inked ribbon which is stretched between the rollers 257 and 258 is also moved toward the left at the instant that printing takes place because of the pressure applied to the inked ribbon by the cylinders 61 to 64 and the rollers 65 to 68. With all of the parts moving together at the same speed as described, no smearing takes place when printing.

The drive rollers 256 and 259 are connectable to the main drive through an electric cluch. The inked ribbon 71 is moved in the machine similar to the movement of a ribbon in a typewriter. First the clutch for the roller 259 is engaged and the other clutch is disengaged, and the ribbon is slowly wound up on the roll 252. A transparent leader section is attached to each end of the ribbon 71, and a photo cell unit 260 is mounted between the drive roller 256 and the roll 251, and another unit 260 is mounted between the drive roller 259 and the roll 252. When an end of the inked ribbon 71 is approaching the printing cylinders, the photocell unit 260 responds to the leader section and actuates a circuit to disengage the clutch for the drive roller 259 and to engage the other clutch, thereby reversing the direction of movement of the inked ribbon. During operation of the machine, the section of the ribbon 71 which is stretched between the two rollers 257 and 258 moves forward and backward as the arms 274 and 282 pivot, but there is a very slow advancement of the ribbon 71 from one roll 251 or 252 to the other roll.

All of the parts of the machine are driven in synchronism by a single electric motor 291 (FIG. 1). A system of drive belts, chains and gears interconnect the motor 291 with the gear 91, the pin wheel 56, the rollers 256 and 259 for the ribbon 71, and the roller 32, and are indicated schematically in FIG. 1. Since the arrangement of the drive train is conventional, it is not described in detail.

While the machine may include a control circuit for automatically starting, stopping and slowing down the drive motor 291 at the appropriate times, this function may also be accomplished manually. As a specific example of manual operation of the machine disclosed herein, assume that a large web roll 22 has been placed in the machine. The large roll 22 is to be separated into shorter sections and rewound in smaller rolls 32, each containing 2,000 lines 47 of stamps, or a total of 30,000 stamps. Assume further that the code symbols 1234 are to be printed on each of the stamps in a short section. The motor 291 is jogged by an operator pressing a button until the printing cylinders 61 to 64 are spaced from the pressure rollers 65 to 68, and a long leader section is attached to the leading end of the roll 22, and is threaded through the machine to the roller 32. The operator locates the web 23 with the holes 51 on the pins of the pinwheels 56 and places the first or leading line 47 adjacent the first printing cylinder 61. Using the knobs 148, the operator adjusts the cylinder 61 to print the number 4, the cylinder 62 to print the number 3, the cylinder 63 to print the number 2, and the cylinder 64 to print the number 1.

The operator then again presses the botton and energizes the motor 291 for operation at regular speed. The pinwheel 56 and the other rollers pull the web 23 through the machine, and the cylinders 61 to 64 and the rollers 65 to 68 are swung up and down until the cylinders print the symbols on the stamps. The machine runs at regular speed until approximately 1760 lines 47 have been printed and the operator then slows the machine down to a relatively slow rate. The machine runs at the slow rate until the 2000th line has been printed by the cylinder 61, and the machine is then immediately stopped. It will be apparent that while all 2000 lines have been printed with the number 4, the last six lines have not been printed with the numbers 1, 2, and 3, and the next six lines have not been printed with the numbers 1 and 2, and the next six lines have not been printed with the number 1.

Assume that the next section of 2000 lines of stamps is to have the number 1235 printed on them. With the machine stopped immediately after the cylinder 61 has printed the 2000th line and the cylinder 61 spaced from the web 23, the operator adjusts the cylinder 61 to print the number 5 by pulling the handle 148 and then turning it to move the symbol 5 to the pointer 154. The operator then jogs the drive motor until the 2000th line has just passed the numbering machine at the printing section 29, and the machine is stopped while the operator resets the numbering machine to zero. The operator then jogs the machine until the 2000th line is at the inspecting and severing station 31. The operator then severs the web 23 between the 2000th line of the first section and the first line of the second section. He winds up the trailing end of the first section on the roller 32, removes the first roll from the roller 32 and places a fresh core on the roller 32. The operator fastens a leader to the leading end of the second section and to the core on the roller 32 and then presses the start button. The machine runs at high speed until approximately 1760 stamps of the second section have been printed, the machine is slowed down, and the cycle is repeated as previously described.

In the foregoing example, the number 1234 was printed on a first section and then the number 1235 was printed on the second section, which required the operator to adjust only the cylinder 61 between the two sections. If more than one number is to be changed, the operator jogs the 2000th line to a point which is just past each printing cylinder requiring a change, and then adjusts the position of the printing cylinder.

We claim:

1. A machine for printing a plurality of grouped symbols on a rapidly moving web, comprising an angularly adjustable printing cylinder associated with each symbol of said group, each of said cylinders having a plurality of angularly spaced printing elements on the periphery thereof, said plurality of printing elements of each cylinder being arranged in a row which extends longitudinally of said web, the printing element of each row closest to the web being in printing position for printing the symbol associated therewith, drive means for cyclically moving said cylinders against and away from the web and thereby printing said symbols on said web, said cylinders being spaced apart in the direction of moveement of the web and said printing elements of the respective cylinders being spaced apart laterally of said direction of movement relative to each other and forming an associated group of printing elements, whereby said cylinders cooperate to print said grouped symbols in laterally spaced relation.

2. A machine as in claim 1, wherein each of said cylinders further includes a plurality of additional spaced apart printing elements, said additional printing elements of each cylinder being arranged in a laterally extending line which includes said first mentioned element, each printing element of each cylinder forming an associated group with a printing element of each of the other of said cylinders and said associated elements of each group being laterally spaced, whereby each of said associated groups of printing elements prints a group of symbols and said groups of symbols are in laterally spaced relation.

3. A machine as in 2, wherein all of said printing elements in a line of each of said cylinders are the same, whereby the symbols of all of said groups are the same.

4. A machine as in claim 1, wherein all of said printing elements of each row are different from one another.

5. A machine as in claim 4, and further including means for angularly adjusting the positions of said cylinders to place different printing elements in said operative printing position.

6. A machine as in claim 5, wherein each of said cylinders further includes a line of spaced apart printing elements associated with each of angularly spaced symbols of each cylinder, said line extending laterally of the direction of movement of said web.

7. A machine as in claim 6, wherein each of said cylinders comprises cylindrical support means, printing plate means having all of said cylinders formed thereon, and means for securing said printing plate means to said cylindrical support means.

8. A machine as in claim 7, wherein said printing plate means is flexible and is folded over the outer surface of said cylindrical support means.

9. A machine as in claim 6, wherein each of said cylinders comprises cylindrical support means and a plurality of coaxial bands mounted on said cylindrical support means, each of said bands having one of said rows of printing elements thereon.

10. A machine as in claim 6, wherein all of the elements of each line are identical.

11. A machine as in claim 1, and further including a bracket at each end of said cylinders for supporting said cylinders, said drive means being connected to said brackets and moving said brackets toward and away from said web.

12. A machine as in claim 1, and further including pressure means associated with each of said cylinders, said pressure means being on one side of said web and said cylinders being on the opposite side of said web, said movement of said cylinders against said web resulting in said cylinders and said pressure means applying pressure on said web.

13. A machine as in claim 12, and further including means for conveying a strip of ink means between said web and said cylinders.

14. A machine as in claim 13, and further including first bracket means for supporting all of said printing cylinders, second bracket means for supporting all of said pressure means, support means connected to said drive means and to said first and second bracket means for moving said bracket means in circular motions, said cylinders and said pressure means being simultaneously moved toward and away from each other, and said cylinders and said pressure means being moved at substantially the same speed as said web.

15. A machine as in claim 14, and further including roller means at opposite ends of said bracket means for guiding said strip of ink means between said cylinders and said pressure means, said roller means being pivotally mounted and being connected to said bracket means, whereby said roller means pivot as said bracket means move in said circular motion.

16. In a printing machine for printing a plurality of groups of symbols on a moving web, the machine including means for supporting a web supply roll and a web rewind roll, and drive means for moving the web longitudinally of the machine from said supply roll to said rewind roll, the improvement comprising a plurality of printing cylinders mounted adjacent said web in longitudinally spaced relation, pressure means mounted adjacent said cylinders on the opposite side of said web, each of said printing cylinders including at least one printing element on the side thereof which is adjacent said web, said drive means moving said cylinders toward and away from said web and the axes of said cylindrical moving in a generally circular motion, said printing elements of said cylinders moving at substantially the speed of the web during printing, said printing element of each cylinder printing one symbol of each of said groups at each time each cylinder is moved against said web, said one printing elements of said cylinders forming an associated group which together print the symbols of each of said groups, and said printing elements of said associated group being laterally offset relative to each other to achieve a lateral offset of the printed symbols of each of said groups.

17. In a printing machine for printing groups of symbols on a moving web, the machine including means for supporting a web supply roll and a web rewind roll, and drive means for moving the web through the machine from said supply roll to said rewind roll, the improvement comprising a plurality of printing cylinders spaced apart in the direction of movement of said web, said printing cylinders being mounted adjacent one side of said web, pressure means mounted adjacent the other side of said web opposite said printing cylinders, means for moving said printing cylinders toward and away from said web and said pressure means without rotating said cylinders, each of said printing cylinders having at least one line of printing elements formed thereon and the printing elements being formed at spaced intervals, said line extending laterally of said direction of movement of said web, the printing elements of each of said cylinders being offset laterally of said direction of movement from the printing elements of the other of said cylinders, and the elements of each cylinder being located in the spaces between the elements of the other cylinders and each printing element of one cylinder cooperating with a printing element of the other of said cylinders to print a group of symbols on said web.

* * * * *